US008555430B2

(12) United States Patent
Nicas

(10) Patent No.: US 8,555,430 B2
(45) Date of Patent: Oct. 15, 2013

(54) IN-SHOWER FOOT SCRUBBER

(76) Inventor: Edgar L. Nicas, North Richland Hills, TX (US)

( * ) Notice: Subject to any disclaimer, the term of this patent is extended or adjusted under 35 U.S.C. 154(b) by 626 days.

(21) Appl. No.: 12/845,047

(22) Filed: Jul. 28, 2010

(65) Prior Publication Data

US 2012/0023694 A1 Feb. 2, 2012

(51) Int. Cl.
*A47K 7/02* (2006.01)

(52) U.S. Cl.
USPC ..... 4/606

(58) Field of Classification Search
USPC ..... 4/606–611
See application file for complete search history.

(56) References Cited

U.S. PATENT DOCUMENTS 2,210,365 A * 8/1940 Gilpin ..... 15/161
2,664,585 A * 1/1954 Gaither ..... 15/265
3,631,560 A * 1/1972 Atkins ..... 15/146
4,520,525 A * 6/1985 Yogi et al. ..... 15/104.92
4,617,917 A * 10/1986 Miller ..... 601/136
4,918,779 A * 4/1990 Burns ..... 15/104.92
5,163,200 A * 11/1992 Carlin et al. ..... 15/104.92
5,177,829 A * 1/1993 Simpson ..... 15/104.92
5,215,348 A * 6/1993 Wen-Hwang ..... 296/97.23
D343,476 S * 1/1994 Tomsick ..... D28/63
5,321,867 A * 6/1994 Probst ..... 15/160
D374,505 S * 10/1996 Garrison ..... D28/63
5,575,034 A * 11/1996 Biernacinski et al. ..... 15/217
5,628,083 A * 5/1997 Hayes ..... 15/244.3
5,729,858 A * 3/1998 Riffel ..... 15/111
5,758,381 A * 6/1998 Rocha ..... 15/160
5,813,078 A * 9/1998 Hogan, Sr. ..... 15/160
5,933,909 A * 8/1999 Keating ..... 15/244.1
5,983,433 A * 11/1999 Chapman ..... 15/104.92
5,996,160 A * 12/1999 Pruitt ..... 15/104.92
5,996,163 A * 12/1999 Galizia ..... 15/160
D439,016 S * 3/2001 Syran et al. ..... D28/63
6,210,350 B1 * 4/2001 Finch ..... 601/136
6,223,379 B1 * 5/2001 Martin ..... 15/104.92
6,253,407 B1 * 7/2001 Bjelkevig ..... 15/160
6,389,631 B1 * 5/2002 Keith ..... 15/104.92
6,405,400 B1 * 6/2002 McClain ..... 15/160
6,418,574 B2 * 7/2002 McDowell ..... 4/606
6,427,279 B1 * 8/2002 White et al. ..... 15/104.92
6,662,398 B1 * 12/2003 Thomson ..... 15/104.92
6,668,842 B1 * 12/2003 Wilke et al. ..... 134/44
6,684,444 B2 * 2/2004 Wheeler et al. ..... 15/110
6,735,807 B2 * 5/2004 Brent ..... 15/104.92
6,832,688 B1 * 12/2004 Rivera et al. ..... 206/581
6,893,508 B2 * 5/2005 Andrews ..... 134/6
7,219,387 B1 * 5/2007 Moore ..... 15/160

(Continued)

*Primary Examiner* — Lori Baker
(74) *Attorney, Agent, or Firm* — Gagnon, Peacock & Vereeke P. C.; Aaron P. Peacock

(57) ABSTRACT

An in-shower foot scrubber which includes an interchangeable scrubbing module having a scrubbing pad that attaches thereto, a wing that protrudes from each side thereof and a finger that protrudes from the front thereof, the finger includes a depressible spring-loaded button, and a scrubbing platform having a top portion and a base, the top portion includes a sloping region, the region includes an inlet that receives the finger of the module, an aperture receives the depressible spring-loaded button of the module to engage the platform to the module and a track disposed at each side of the region wherein each track defines a channel for slidably engaging each wing of the module to the platform, the base includes a shoulder that juts out horizontally therefrom to resist movement from the platform during a scrubbing session.

9 Claims, 6 Drawing Sheets

(56) References Cited

U.S. PATENT DOCUMENTS

| | | | | |
|---|---|---|---|---|
| 7,266,857 | B1 * | 9/2007 | Mezyed | 15/104.92 |
| 7,278,431 | B2 * | 10/2007 | Anderson et al. | 132/76.4 |
| 7,500,282 | B1 * | 3/2009 | Park | 15/160 |
| 7,500,488 | B1 * | 3/2009 | Long | 134/136 |
| 7,578,021 | B1 * | 8/2009 | Figueroa | 15/104.92 |
| D599,957 | S * | 9/2009 | Reggaro | D28/63 |
| 7,757,338 | B2 * | 7/2010 | Rossiter et al. | 15/258 |
| D620,713 | S * | 8/2010 | Polser | D4/116 |
| 7,877,826 | B2 * | 2/2011 | Franklin | 4/615 |
| 7,967,521 | B2 * | 6/2011 | Schiavo | 401/188 R |
| 8,156,945 | B2 * | 4/2012 | Hart et al. | 132/76.4 |
| 8,191,196 | B2 * | 6/2012 | Aguilar et al. | 15/210.1 |
| 2007/0022527 | A1 * | 2/2007 | Russo et al. | 4/606 |

* cited by examiner

IN-SHOWER FOOT SCRUBBER

DETAILED DESCRIPTION

Figure 1:
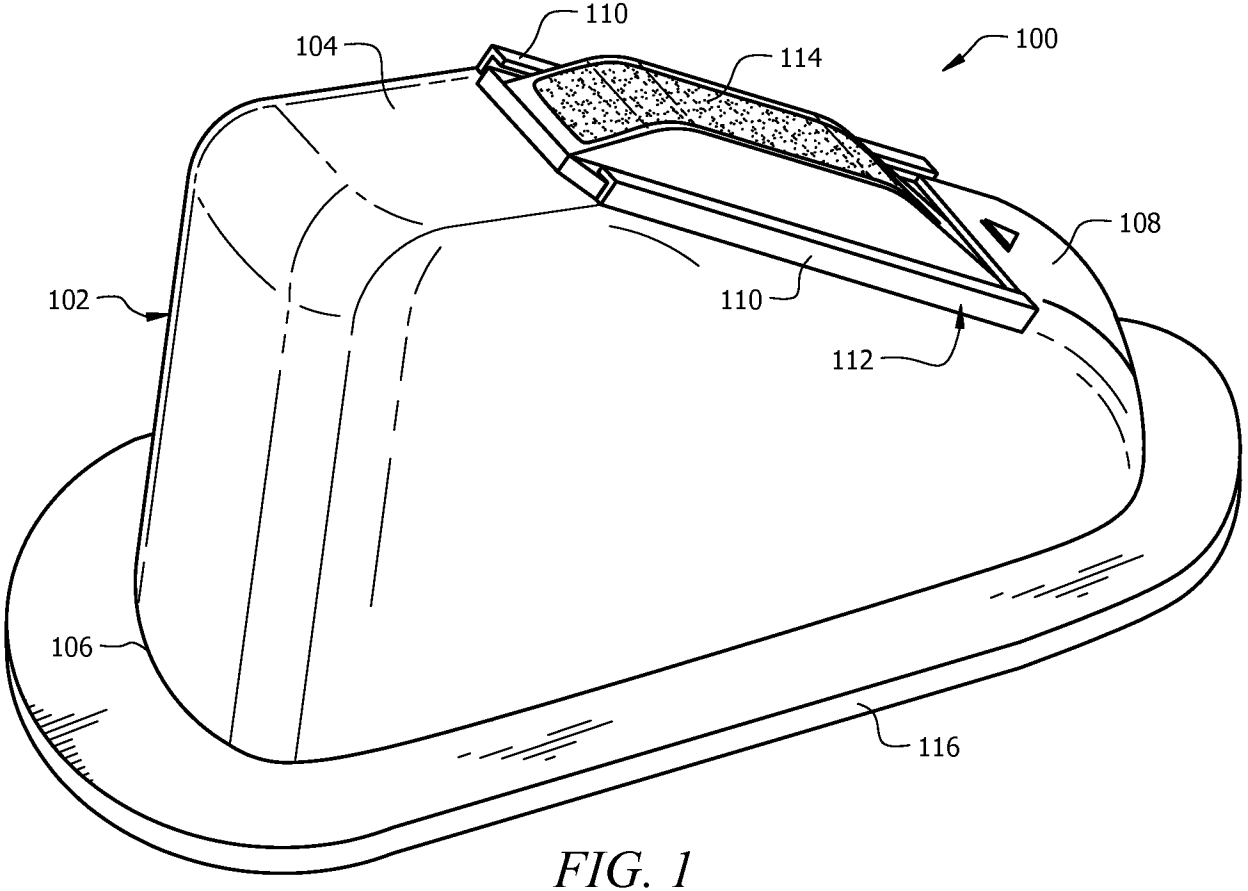
FIG. 1 is a perspective view of a scrubbing module slidably engaged to a scrubbing platform comprising an embodiment of the present invention.

By nature, humans are mobile creatures. For thousands of years, the primary tool for human mobility has been the human foot. Fortunately, nature saw fit to establish each human with a pair of feet. Each foot, working in concert with the other, helps provide each human the ability to stand, walk, jog, and run. Additionally, feet assist in balance and weigh distribution as well as aid in other tasks such as kicking, jumping, pushing, etc. Without feet, everyday tasks become difficult, if not impossible. For example, accelerating and decelerating an automobile becomes a problematic endeavor; swimming in water quickly becomes exhausting as the hands become the de facto sole propelling object; bicycling becomes difficult; participating in sports such as in football or soccer becomes challenging. As is evident, a person's feet are an important part of one's body. Without feet, a person's mobility is greatly restricted, and simple everyday tasks become complex and troublesome.

Because of its paramount importance to the human body and to everyday life in general, a person's feet should be protected and maintained. Such protection and maintenance includes regularly cleaning, grooming, and caring for the various parts and portions of each foot, such as the forefoot, midfoot, and hindfoot as well as the sole, heel and associated skin thereon. Improper care and attention can result in hyperkeratosis, clavus, heloma and tyloma, which are generally known in layman's terms as differing types of corns and/or calluses. The infliction of corns and/or calluses can cause pain, especially when triggered by the excess pressure or constant rubbing on a portion of the foot such as by wearing a defective or improperly sized shoe.

To prevent corns or calluses from initially forming or to treat corns or calluses after they have already formed on a portion of the foot, a person should cleanse and scrub the skin around the foot, scrapping away the dead skins cells. The regular practice of foot grooming via cleansing and scrubbing will aid in the prevention of infections and diseases within the regional area of the foot, will treat reoccurring foot ailments, will maintain the vibrant health of the foot, and will relieve foot soreness and pain caused by the toil of life's everyday activities as the foot muscles are massaged and relaxed. Therefore, foot scrubbing is necessary for good bodily health as well as the maintenance of a healthy and active lifestyle.

Conventional methods and tools utilized for foot scrubbing are fraught with problems and do not adequately and easily cleanse and scrub substantial areas of the foot. One reason is that feet come in all different shapes and sizes. For example, there are small feet, large feet, flat feet, highly-arched feet, wide feet, narrow feet, and feet that are combinations of the above. No two people have exactly the same sized or shaped foot. As such, at least twelve billion different shapes and sizes of feet exist today because, as studies have shown, the world comprises inhabitants of at least six billion people. Therefore, a device for foot scrubbing is needed that is contoured to the differing shapes and sizes of the many feet in today's world.

Furthermore, the traditional means of scrubbing one's foot can cause muscle strain, fatigue, and pain. For example, using traditional means, a person desirous to scrub his/her foot, generally, must approach scrubbing in one of two general ways. In the first approach, the person must rest his/her body against a non-movable object for stability such as a chair, lift the foot that is to be scrubbed off the ground toward fingers which grip a standard, rough-like, scrubbing material, position the scrubbing material at the portion of the foot to be scrubbed, press the scrubbing material against that portion and then scrub repeatedly using the concerted muscles of the arm, hand and fingers. This approach quickly becomes tiring and can exhaust the various muscles of the body as the body contorts to allow the person to reach and scrub the differing portions of the foot.

In the second approach, the person lifts his/her foot off the ground, positions the bottom of the foot on a standard, rough-like, scrubbing material, presses the bottom of the foot against the scrubbing material, and then scrubs repeatedly. This approach, while reducing the muscle strain of the neck, back, arm, hand and fingers caused by the first approach, may not adequately scrub the various portions of the foot desired because the standard, scrubbing material is not designed for the shape of that person's foot. For example, if the foot's structure consists of an extremely high arch and the standard, scrubbing material is not designed and contoured for such a foot structure, then substantial portions of the foot may not be cleansed and scrubbed.

Embodiments of the present invention provide many advantages when cleansing and scrubbing a foot. Among the advantages is the ability of the present invention to more easily and more efficiently cleanse and scrub differing types, shapes and sizes of feet. This is accomplished through a system which allows the present invention to adapt to the shape, size and/or design of a particular foot. Contrary to the concept and operations of other types of scrubbing devices used today, the concept of the present invention rejects the notion that one size fits all. Because of its adaptation to the dimension of a particular user's foot, the present invention provides an easier and more efficient approach to foot scrubbing. The user experiences a customized foot scrubbing session that meets the dimensional needs of the user's foot. For example, a user having a wide foot coupled with a high arch can adapt the present invention to his/her foot. As such, the user experiences an improved foot scrubbing session as the scrubbing pad simultaneously makes contact with more of the skin around the foot. Additionally, the adaptation of the scrubbing pad's design increases pressure to the appropriate areas of the foot, thereby enhancing the effectiveness of the scrubbing session.

Another of the many advantages of the embodiments of the present invention is the interchangeability of parts, namely the interchangeability of the scrubbing pad and the scrubbing module. While interchangeability provides for the adaptation of the present invention to differing shapes and sizes of feet, it also provides for a healthier foot scrubbing session when the present invention is used at different times by different users. During a foot scrubbing session, dead skin cells are scraped away. Many times, these skin cells remain on the scrubbing pad long after the scrubbing session has ended. Thoroughly cleaning the scrubbing pad may not eliminate all of the dead skin cells and other debris that was collected on the scrubbing pad. For sanitary reasons, a person should not use a scrubbing pad that was previously used by another. Therefore, embodiments of the present invention provide a system for exchanging the scrubbing pad before, during or after a foot scrubbing session, thereby allowing multiple users to utilize the present invention in a sanitary fashion.

Still another of the many advantages of the embodiments of the present invention is the variability and adjustability of the scrubbing angle applied to the foot during a scrubbing session. While embodiments of the present invention provide for scrubbing pad that is adaptable to the differing shapes and sizes of feet, a scrubbing session will not be as efficient and effective as possible if the scrubbing is not performed at an optimal angle relative to the foot. Therefore, embodiments of the present invention utilize a system which allows the user to adjust the angle at which the present invention engages the foot. This feature ensures that maximum effectiveness during a scrubbing session is achieved.

By adapting the scrubbing pad, interchanging the scrubbing module and adjusting the scrubbing angle, the aforementioned advantages can be realized. However, other advantages will become apparent to persons of ordinary skill in this art upon a study of the following description and associated drawings.

Of the many embodiments of the present invention, one embodiment comprises a pre-designed scrubbing pad that interacts with a user's foot during a scrubbing session. The scrubbing pad is affixed to a pre-designed scrubbing module and substantially conforms to the shape of the upper portion of the scrubbing module. Because the scrubbing module is designed and constructed to cause the scrubbing pad to optimally interact with a particular type of foot, the user experiences a satisfactory scrubbing session. The scrubbing module engages a top portion of a scrubbing platform that slopes downward and that is optimally angled to receive a user's foot while the foot interacts with the scrubbing pad during a scrubbing session.

Furthermore, the scrubbing module is interchangeable. Therefore, the user, at any time and for any reason, can detach the scrubbing module from the scrubbing platform and reattach another scrubbing module thereto. For example, a user can replace the scrubbing module if the scrubbing pad attached thereto has become worn through continuous use, has been used by another person, or is dimensionally improper in shape and/or size relative to that particular user's foot.

The base of the scrubbing platform comprises a shoulder which juts out therefrom. Attached to the bottom of the shoulder is a non-slick material such as rubber or the like that makes contact with a flooring surface such as the flooring in a shower, thereby preventing the scrubbing platform from easily moving along the surface of the floor during a scrubbing session. An increase in the shoulder's horizontal length coupled with a corresponding increase in the non-slick material attached thereto will increase the area of contact between the non-slick material and the surface of the floor. Consequently, increasing the contact area will diminish the undesired movement of the scrubbing platform during use in a scrubbing session.

Another of the many embodiment of the present invention comprises an adjustable scrubbing platform. Because of differing variations between users as well as differing limitations among users such as height, joint flexibility in the knees and ankles, length of the legs, and the size and shape of the feet, the scrubbing platform must adapt to each user. Accordingly, a portion of the top of the scrubbing platform slopes downward and is angled to receive a user's foot while the foot interacts with the scrubbing pad. While a satisfactory sloping angle can be determine for a general type of foot, an optimal scrubbing session requires an adjustable scrubbing platform such that the platform's height and/or sloping angle can be adjusted. Therefore, embodiments of the present invention provide for an adjustment of the scrubbing platform's height and/or sloping angle by a user, thereby optimizing the scrubbing session.

It should be noted that other embodiments are envisioned. One such embodiment can comprise a scrubbing pad that attaches directly to the sloping region of a scrubbing platform. For example it is envisioned that the scrubbing platform can have a top portion wherein a region of the top portion would slope downward. This sloping region can be designed and contoured to provide a user with a satisfactory scrubbing session. Furthermore, the scrubbing pad can attach to the sloping region of the scrubbing platform. This type of embodiment contemplates that neither the scrubbing pad nor anything attached thereto would be detachable or removable. As such, the scrubbing pad would be stationary and unremovable.

For a better understanding of some of the many embodiments of the present invention, drawings are included herewith. In FIG. 1 of the drawings, an embodiment of the present invention is illustrated. An in-shower foot scrubber 100 is depicted in a mode ready for use. The in-shower foot scrubber 100 includes a scrubbing platform 102 having a top portion 104 and a base 106. The top portion 104 includes a sloping region 108 that slopes downward toward the base 106 at an angle. For optimal results during a scrubbing session, the angle of the slop should be between 40 degrees and 60 degrees. Within the sloping region 108 is a track 110 positioned on each side of the scrubbing platform 102 which slidably engage a scrubbing module 112 to the scrubbing platform 102. Attached to the scrubbing module 102 is a scrubbing pad 114 which interacts with a foot during a scrubbing session. The base 106 includes a shoulder 116 to help prevent the scrubbing platform from sliding around on a surface such as the floor of a shower during a scrubbing session.

The scrubbing platform 102 including the associated parts thereof such as the top portion 104, base 106, sloping region 108, tracks 110 and shoulder 116 form the assemblage of the scrubbing platform 102. Furthermore, the properties of the scrubbing platform 102 include material that is durable, hard, and lightweight. As such, the scrubbing platform 102 can be constructed of polymer, plastic or the like.

Figure 2:
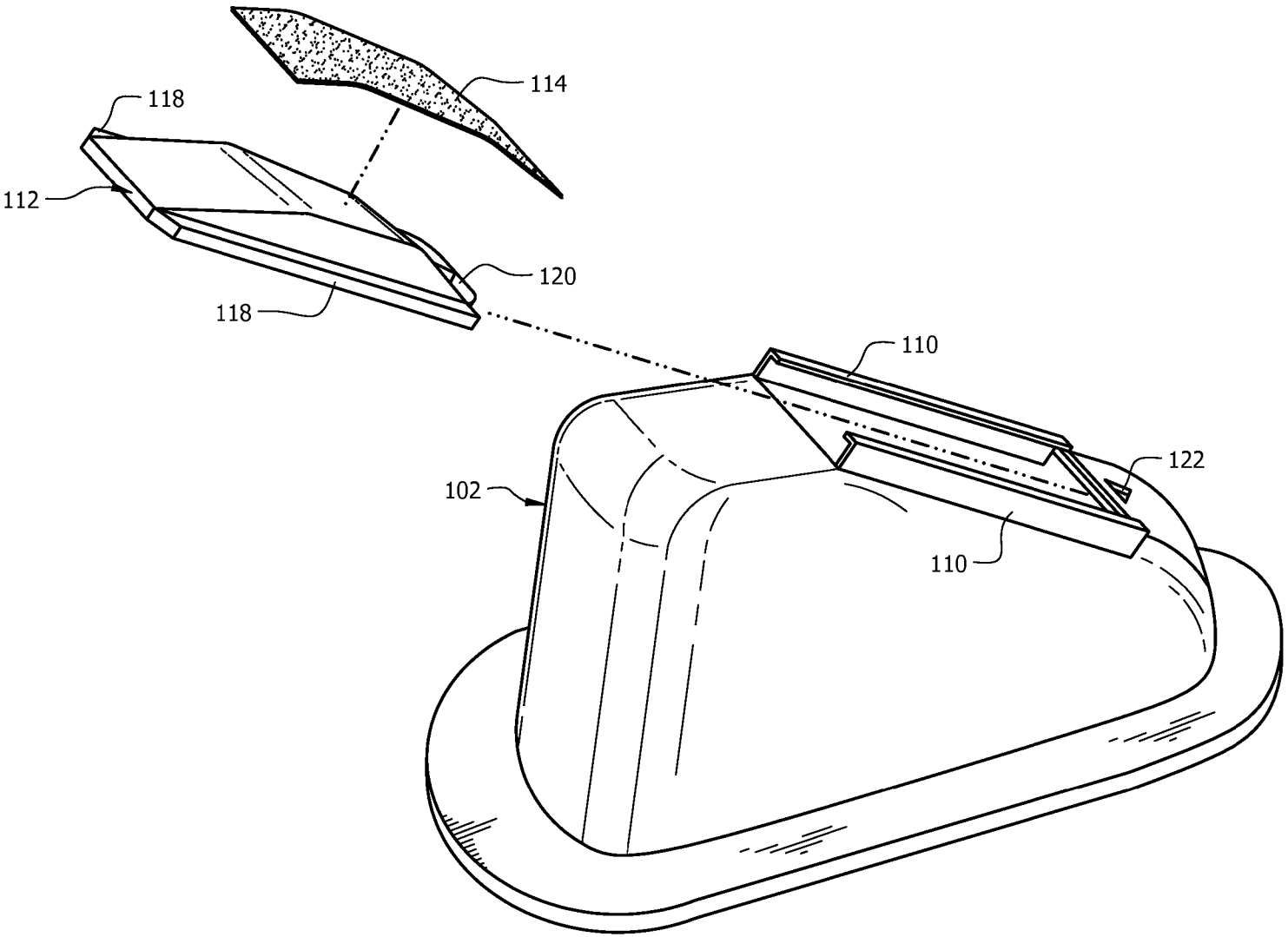
FIG. 2 is an exploded perspective view of a scrubbing module having a scrubbing pad attached thereto and the scrubbing module slidably engaging the scrubbing platform as shown in FIG. 1.

FIG. 2 illustrates the scrubbing module 112 that slidably engages with the scrubbing platform 102. The scrubbing module 112 includes a scrubbing pad 114 that is attached thereto. The scrubbing pad 114 can be attached to the scrubbing module 112 in a variety of different ways. For example, the scrubbing pad 114 and be secured to the scrubbing module 112 using adhesives, screws, nails, pins, etc.

The material property of the scrubbing pad 114 is of a kind that is known to those of ordinary skill in the art of foot scrubbing. For example, the scrubbing pad 114 can be made of pumice or a similar material. Furthermore, the scrubbing pad 114 should be of a material that is useful in preventing and/or eliminating calluses and corns from the foot while also removing dead skin cells.

The properties of the scrubbing module 102 include material that is durable, hard, and lightweight. As such, the scrubbing platform 102 can be constructed of polymer, plastic or the like.

Because the scrubbing module 112 is interchangeable, it can be disengaged and removed from the scrubbing platform 102 and another scrubbing module 112 can be engaged and inserted thereto. The scrubbing module 112 includes a wing 118 on each side which, when engaging the scrubbing module 112 to the scrubbing platform 102, is positioned within the channel defined by each track 110 and inserted therein. The scrubbing module 112 includes a protruding finger 120 disposed at an end thereof such that, when engaging the scrubbing module 112 to the scrubbing platform 102, the finger 120 is inserted into the scrubbing platform 102. Within the sloping region 108, the scrubbing platform 102 defines an aperture 122 for receiving a depressible spring-loaded button 124.

Figure 3:
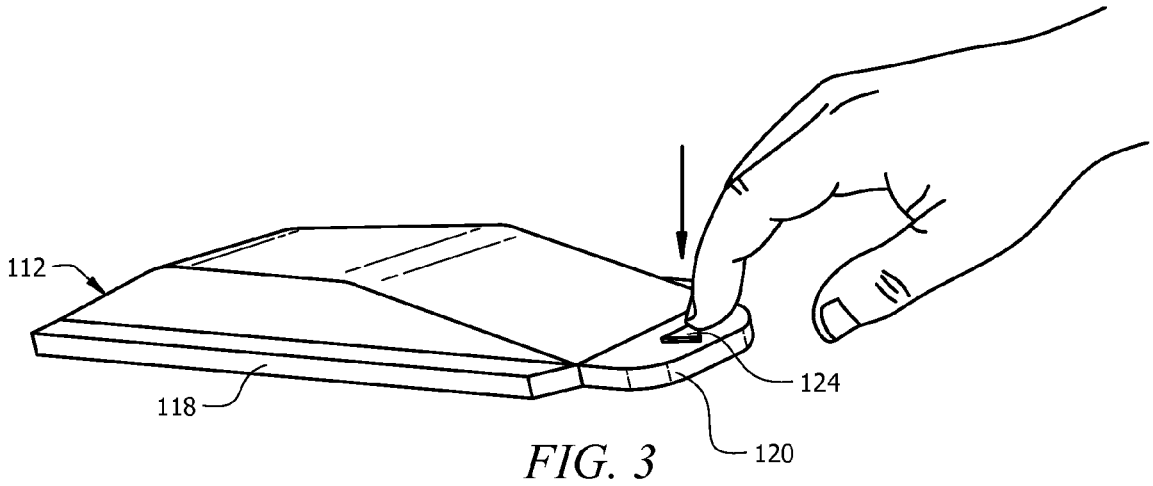
FIG. 3 is a perspective view of a scrubbing module.

As illustrated in FIG. 3, the finger 120 of the scrubbing module 112 includes a depressible spring-loaded button 124 that is received into the aperture 122 of the scrubbing platform 102 upon the engagement of the scrubbing module 112 to the scrubbing platform 102. The channel formed by each track 110 and the button 124 received into the aperture 122 interlocks the scrubbing module 112 to the scrubbing platform 102.

To disengage the scrubbing module 112 from the scrubbing platform 102, the spring-loaded button 124 is depressed and the scrubbing module 112 is removed therefrom. After the spring-loaded button 124 is depressed, each wing 118 of the scrubbing module 112 travels along the channel defined by each track 110 of the scrubbing platform 102 until the scrubbing module 112 is fully disengaged from the scrubbing platform 102.

Figure 4:
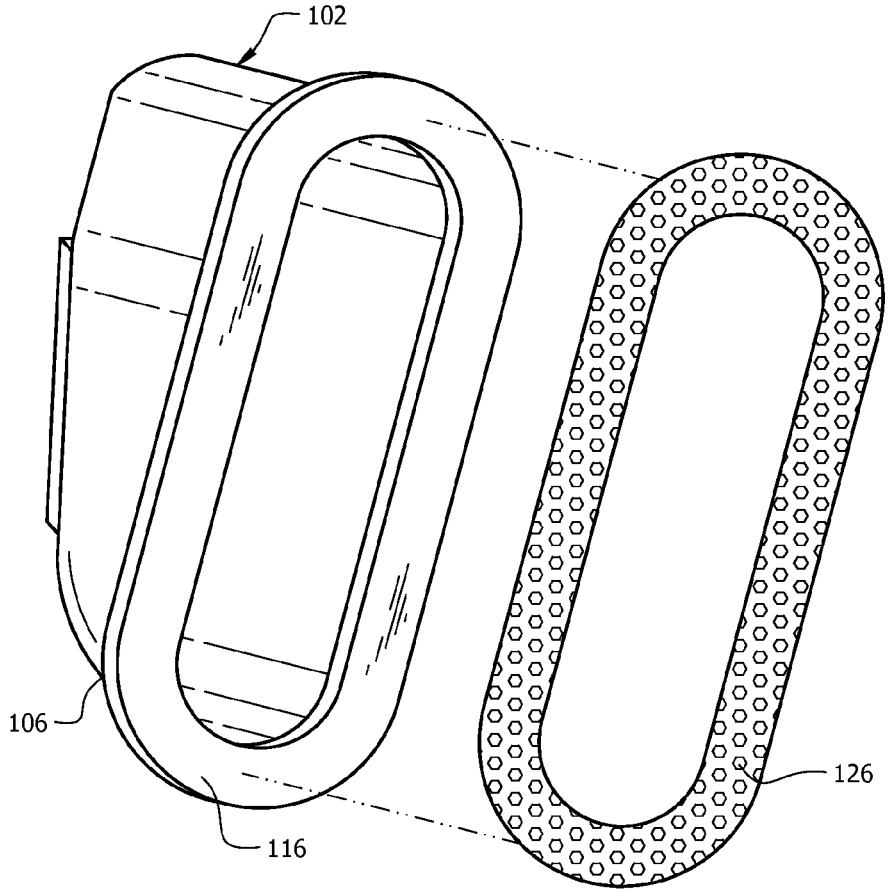
FIG. 4 is an exploded perspective view of the bottom of a scrubbing platform having a non-slick like material attached thereto.

As illustrated in FIG. 4, the base 106 of the scrubbing platform 102 includes a shoulder 116 that juts out horizontally from the scrubbing platform 102. The length of the jutting is determined according to the desired level of stability and reduction of movement when the in-shower foot scrubber 100 is in use. Attached to the bottom of the shoulder 116 is a non-slick material 126 such a rubber or the like. The non-slick material 126 can be secured to the bottom of the shoulder 116 using an adhesive, fastener, or similar method of attachment.

It should also be noted that the interior of the scrubbing platform 102 is hollow, making the scrubbing platform 102 as lightweight as possible. Furthermore, those persons of ordinary skill in this art will appreciate the ease and space-saving capabilities that result when multiple in-shower foot scrubbers 100 are transported. Because of the hollow interior of the scrubbing platform 102, each in-shower foot scrubber 100 can be stacked one on top of another, thereby allowing the transportation of many while utilizing minimal space.

Figure 5:
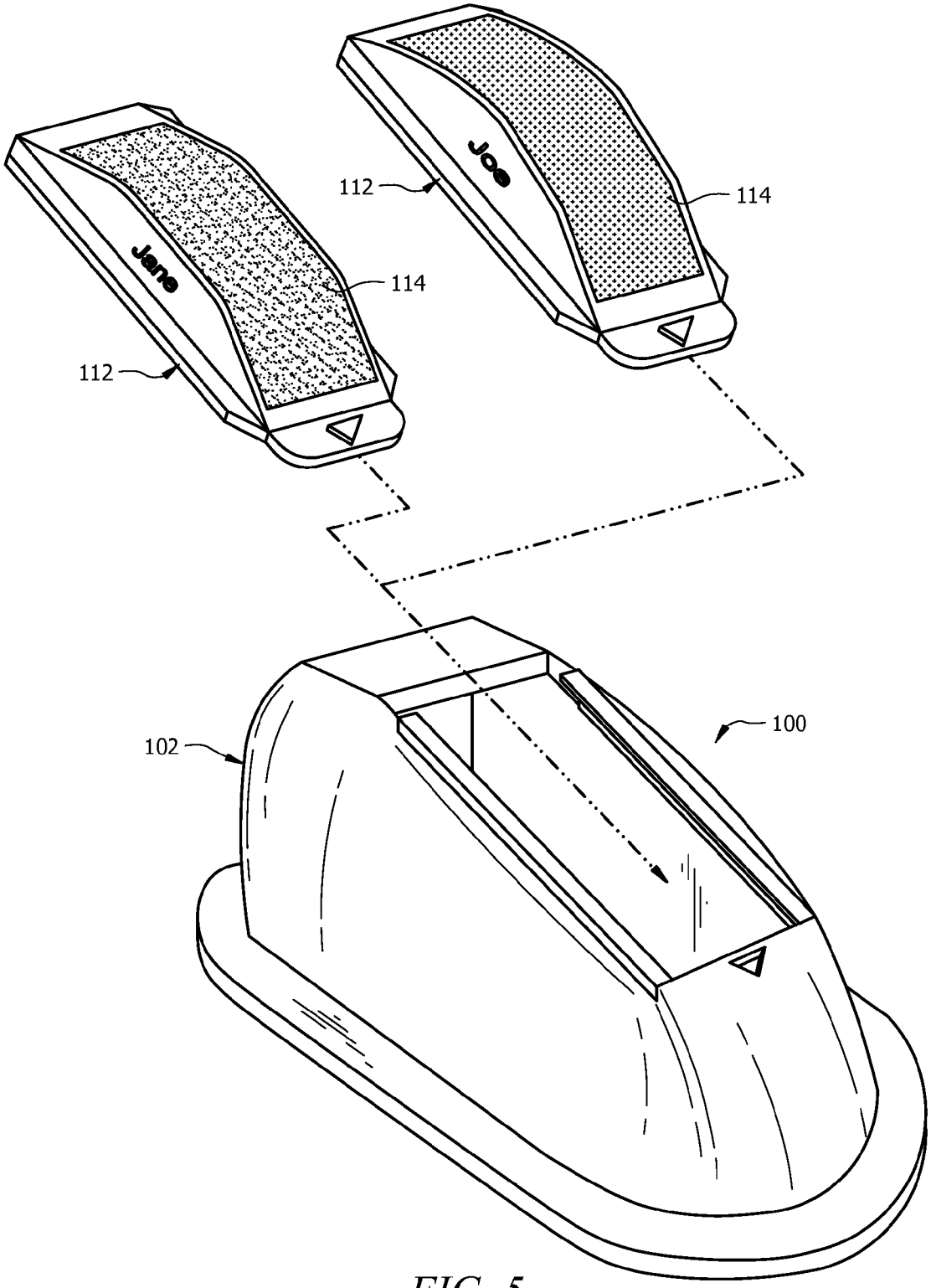
FIG. 5 is a exploded perspective view of a first scrubbing module slidably disengaging from a scrubbing platform and a second scrubbing module slidably engaging to the scrubbing platform.

FIG. 5 illustrates the interchangeability of the scrubbing module 112. The scrubbing platform 102 can exchange one scrubbing module 112 for another. A user may want to disengage and remove a scrubbing module 112 because the scrubbing pad 114 attached thereto has become worn through continuous use, has been used by another person, or is dimensionally improper in shape and/or size for the user's foot. After disengaging and removing the unwanted scrubbing module 112, the user can insert and engage another scrubbing module 112 having a scrubbing pad 114 attached thereto that has not been worn by use, has not been used by another person, or is a correct size and shape to provide an optimal scrubbing session for the user's foot. An example is shown in FIG. 5 wherein a in-shower foot scrubber 100 includes two scrubbing modules 112 that can be interchanged.

Figure 6:
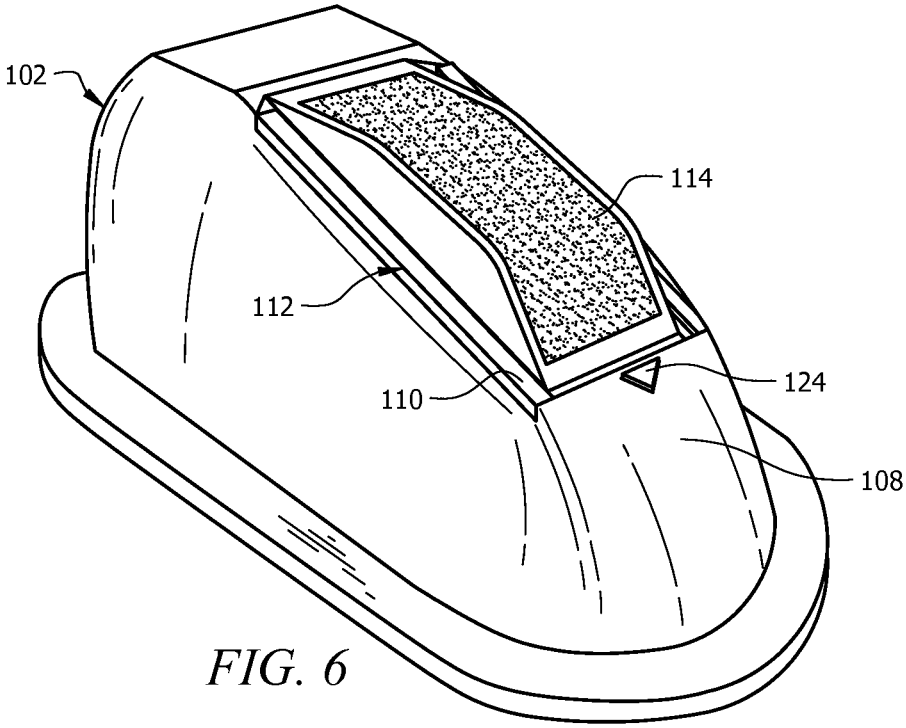
FIG. 6 is a perspective view of a scrubbing module engaged to a scrubbing platform and ready for use.

FIG. 6 illustrates the scrubbing module 112 engaged to the scrubbing platform 102. To disengage and remove the scrubbing module 112 from the scrubbing platform 102, a user can press the spring-loaded button 124 and then pull the scrubbing module 112 along the chamber defined by each track 110.

Persons of ordinary skill in this art will appreciate a further embodiment of this present invention which includes the ability of a user to adjust the angle of the sloping region 108. Because the scrubbing platform 102 engages the scrubbing module 112 within the sloping region 108, a user would enjoy additional control over the effectiveness of the scrubbing session. By further customizing the in-shower foot scrubber 100 to each individual user, each user will experience a satisfying and fulfilling scrubbing session as the scrubbing pad 114 properly and optimally interacts with the user's foot.

Figure 7:
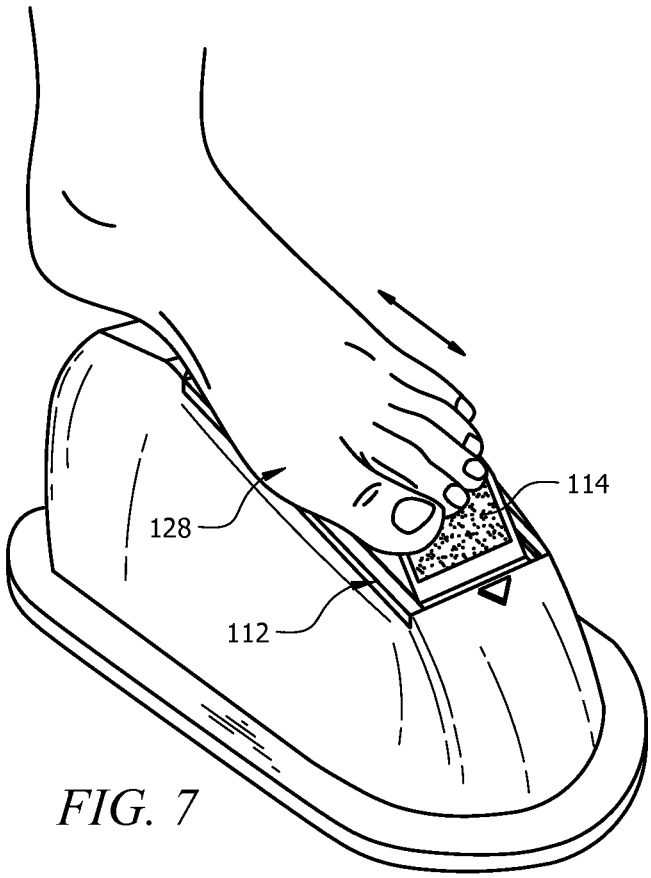
FIG. 7 is a perspective view of a foot interacting with an embodiment of the present invention during a foot scrubbing session.

FIG. 7 illustrates a scrubbing session in progress. The scrubbing module 112 receives a foot 128 to scrub, and the scrubbing pad 114 interacts with the foot 128. The user stands upright, close to the in-shower foot scrubber but slightly behind it. Using leg and foot muscles, the user rubs the foot 128 on the scrubbing pad 114 by applying pressure as well as various types of motions such as rotational motion. As the foot 128 scrubs against the angled scrubbing pad 114, the calluses and dead skin cells fall off.

Figure 8:
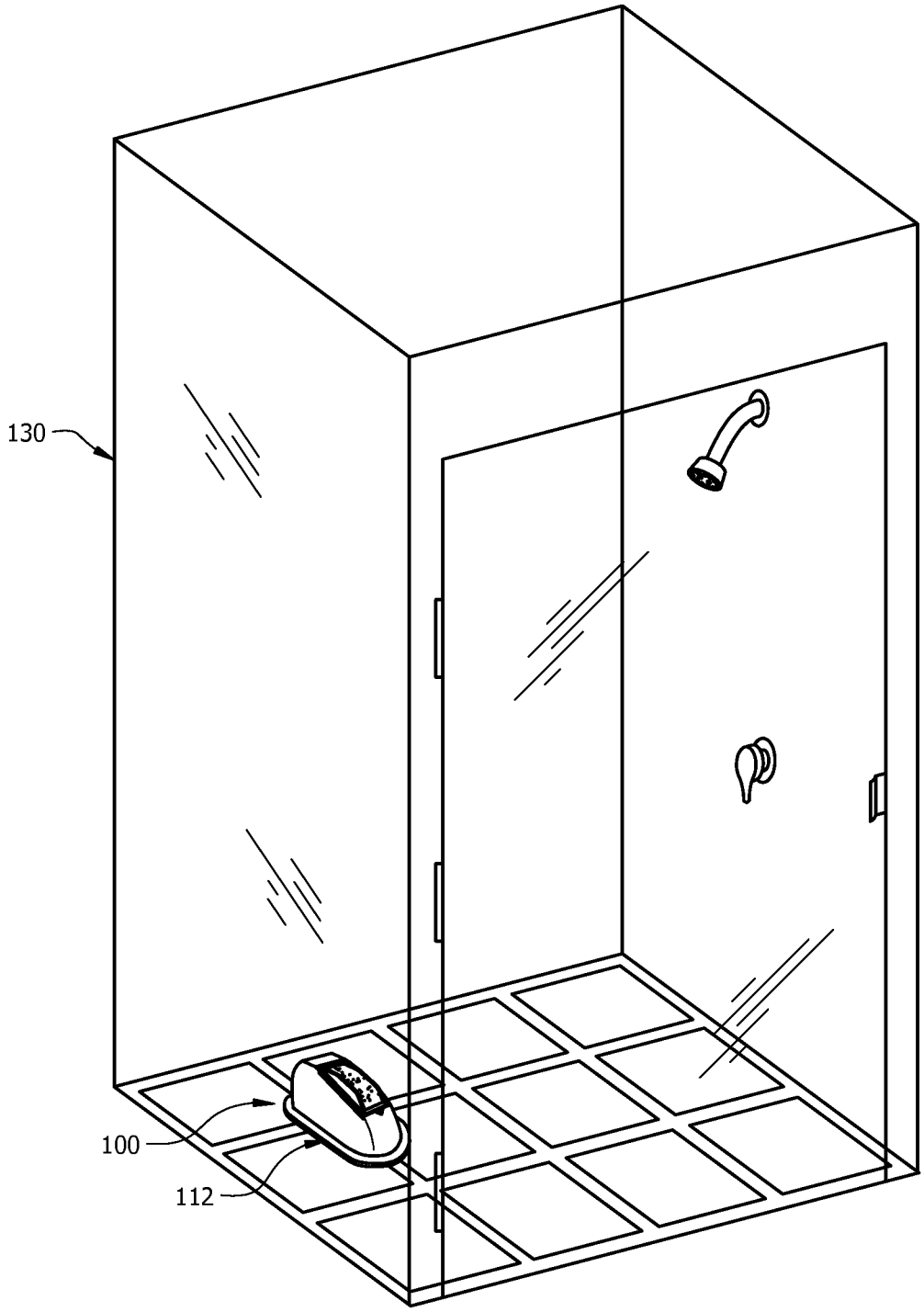
FIG. 8 is a perspective view of an embodiment of the present invention positioned on the floor of a shower.

FIG. 8 illustrates the in-shower foot scrubber 100 positioned in a shower space 130. While the in-shower foot scrubber 100 can be used almost anywhere, it has been specifically designed for use in a shower space 130. If a household comprises several individuals who utilize the same shower space 130 and who each scrub their feet, the in-shower foot scrubber 100 can remain in the shower space 130 without having to be moved and each individual can utilize it. Because the in-shower foot scrubber 100 includes a scrubbing module 112 that can be interchanged, each individual need only interchange the scrubbing module 112 with one to his/her liking. In doing so, the user will receive an optimal foot scrubbing session.

The embodiments of the present invention apply to scrubbing platforms, regardless of type, function or properties, scrubbing modules, regardless of type, function or properties, scrubbing pads, regardless of type, function or properties, tracks, regardless of type, function or properties, fingers, regardless of type, function or properties, shoulders, regardless of type, function or properties, spring-loaded buttons, regardless of type, function or properties, and feet, regardless of type, design, shape, or size.

Although the many embodiments of the invention have been illustrated in the accompanying Drawings and described in the foregoing Detailed Description, it should be understood that the present invention is not limited to the embodiments disclosed, but is capable of numerous rearrangements, modifications, and substitutions of parts and elements without departing from the spirit of the invention.

What is claimed is:

1. An in-shower foot scrubber comprising: an interchangeable and pre-designed scrubbing module having a pre-designed scrubbing pad that attaches thereto and that interacts with a foot, a wing that protrudes from each side thereof and a finger that protrudes from the front thereof, the finger includes a depressible spring-loaded button; and a scrubbing platform having a top portion and a base, the top portion includes a sloping region that slopes downward toward the base, the sloping region includes an inlet that receives the finger of the interchangeable scrubbing module, an aperture defined by the scrubbing platform that receives the depressible spring-loaded button of the interchangeable scrubbing module to engage the scrubbing platform to the interchangeable scrubbing module and a track disposed at each side of the sloping region wherein each track defines a channel for slidably engaging each wing of the interchangeable scrubbing module to the scrubbing platform, the base includes a shoulder that juts out horizontally therefrom to resist movement from the scrubbing platform during a scrubbing session, the shoulder includes a non-slick material that attaches thereto.

2. The in-shower foot scrubber of claim 1 wherein the interior of the interchangeable scrubbing module is hollow.

3. The in-shower foot scrubber of claim 1 wherein the interior of the scrubbing platform is hollow.

4. The in-shower foot scrubber of claim 1 wherein the interchangeable scrubbing module is comprised of plastic.

5. The in-shower foot scrubber of claim 1 wherein the scrubbing platform is comprised of plastic.

6. The in-shower foot scrubber of claim 1 wherein the scrubbing pad is comprised of pumice.

7. The in-shower foot scrubber of claim 1 wherein the non-slick material is rubber.

8. The in-shower foot scrubber of claim 1 wherein the angle of the sloping region on the scrubbing platform is adjustable by a user.

9. The in-shower foot scrubber of claim 1 wherein the angle of the sloping region is between 40 degrees and 60 degrees.

* * * * *